United States Patent [19]

Saphir et al.

[11] 4,433,328

[45] Feb. 21, 1984

[54] MOTION SENSING ENERGY CONTROLLER

[76] Inventors: Marc E. Saphir, 4 Commodore Dr., Suite 441, Emeryville, Calif. 94608; Michael A. Reed, 3086 W. Avenida Cresta, Tucson, Ariz. 85705

[21] Appl. No.: 112,387

[22] Filed: Jan. 16, 1980

[51] Int. Cl.[3] ..... G08B 13/24

[52] U.S. Cl. ..... 340/555; 250/340; 340/554; 343/5 PD; 362/802; 367/94

[58] Field of Search ..... 340/541, 552–556; 250/340, 338, 341; 362/20, 802; 315/149, 150, 159; 356/51, 4; 367/93, 94; 343/5 PD

[56] References Cited

U.S. PATENT DOCUMENTS

| | | | |
|---|---|---|---|
| 3,459,961 | 8/1969 | Ravas | 367/94 X |
| 3,680,047 | 7/1972 | Perlman | 340/556 |
| 3,719,938 | 3/1973 | Perlman | 340/556 |
| 3,934,156 | 1/1976 | Galemmo et al. | 367/94 X |
| 3,961,321 | 6/1976 | Moss | 367/93 |
| 3,984,686 | 10/1976 | Fletcher et al. | 250/338 X |
| 4,021,679 | 5/1977 | Bolle et al. | 367/93 X |
| 4,035,798 | 7/1977 | Hackett | 340/552 X |
| 4,193,055 | 3/1980 | Barnum | 367/94 |

*Primary Examiner*—Glen R. Swann, III

*Attorney, Agent, or Firm*—Cahill, Sutton & Thomas

[57] ABSTRACT

A moving object sensing processor responsive to slowly varying motions of a human being or other moving object in a zone of interest employs high frequency pulse modulated non-visible radiation generated by a radiation generating source, such as an LED, and detected by a detector sensitive to radiation of a preselected wavelength which generates electrical signals representative of the reflected radiation received from the zone of interest. The detectorsignals are processed to normalize the base level and remove variations due to background level changes, and slowly varying changes in the signals are detected by a bi-polar threshold detector. The control signals generated by the threshold detector in response to slowly varying motion are used to control the application of power to a utilization device, such as a set of fluoroescent lights in a room, the power being applied in response to detection of such motion and being automatically terminated in the absence of such motion after a predetermined time period established by a settable incrementable counter.

46 Claims, 13 Drawing Figures

MOTION SENSING ENERGY CONTROLLER

BACKGROUND OF THE INVENTION

This invention relates to the field of systems for sensing the presence or absence of a human being in a zone of interest. More particularly, this invention relates to the field of devices of this type used to control the operation of devices requiring the application of power, such as energy control systems, alarm detectors and the like.

Devices are known which serve to sense the presence or absence of a human being from a zone of interest, such as a room, hallway, outdoor compound or the like. In general, such devices fall into one of two classes: active or passive. Passive devices typically function by sensing a threshold change in the amount of radiation sensed by the device whenever a human being enters a room or similar confined area. Active devices typically include a transmitting device for transmitting radiation of a particular frequency, such as infrared electromagnetic radiation, ultrasonic radiation or microwave radiation, along a confined beam path, and separate detector means coupled to follow-on electronics for sensing an interruption in the radiation beam which persists longer than a predetermined minimum time period and which occurs whenever an object interrupts the radiation beam path. In another type of active device, such as that disclosed in U.S. Pat. No. 4,021,679, a transmitting device propagates radiation of a predetermined frequency towards a zone of interest, such as a doorway to a room, and a sensing device detects the back reflected radiation which occurs whenever an object or a person enters this irradiated zone, the detector being coupled to follow-on electronic circuitry which activates the electrical lighting in the room in response to the detection of reflected radiation above a predetermined threshold. In this system, a separate capacitive comparator circuit is required to deactivate the lighting. Both the passive and the active types of devices noted above are more typically used as intrusion detectors, burglar alarms, or the like.

Known human presence sensing systems suffer from a number of disadvantages. Passive devices, for example, are highly sensitive to changes in the level of the preselected radiation caused by other physical events than that desired to be detected—viz, the sudden presence of a human being. Thus, a sudden change in room temperature caused by activation of a heating system, thermal conduction currents, and thermal convection currents can all trigger passive devices, which typically rely upon radiation in the infrared region. Active devices can be triggered by a wide variety of false events, among which are sudden air movements within a room, time varying air drafts, acoustic noise generated by nearby equipment, such as bells, sirens, machinery and the like, the movement of air circulating fans, the intrusion of rodents and small animals, such as cats and dogs, mechanical vibrations of the structure in which the room is located, reflection from highly polished surfaces, reduction of reflectivity of a room due to carpets and drapes, water movement in water conduits, water noise from faulty valves, RF interference, AC line transients, radar interference and cross-talk interference between adjacent sensors. Efforts to devise a human presence detector devoid of the above disadvantages have not met with success to date.

SUMMARY OF THE INVENTION

The invention comprises a human motion sensor which is relatively inexpensive to manufacture, can be installed with a minimum of technical ability, is substantially unaffected by environmental changes in the zone of interest (e.g. temperature, stray radiation and the like), and which provides a highly reliable detection of the presence or absence of a human being.

In the most general aspect, the invention comprises means for transmitting high frequency modulated radiation lying in a preselected portion of the radiation spectrum, means for synchronously detecting the amount of radiation reflected back from the physical objects in the zone of interest (e.g. walls, floor, furniture, and human beings), and means responsive to the presence of slowly varying changes in the high frequency modulated radiation for generating a control signal indicative of the presence of a human being in the zone of interest. The radiation transmitted preferably comprises high frequency pulse modulated radiation lying outside the visible portion of the spectrum, particularly within the infrared portion of the spectrum, generated by operating one or more radiation sources on a high frequency pulsed basis, typically at a frequency of about 20 KHz. The radiation is detected by means of one or more detectors capable of sensing radiation of the particular wave length chosen, and electronic circuitry for normalizing the representative electrical signals generated by the detector in order to remove variations in the background radiation level. In the preferred embodiment, the normalizing circuitry includes means for inverting and amplifying the representative electrical signals, gating means operated in sychronism with the radiation transmitter pulse generator circuitry for gating a predetermined portion of each cycle of the inverted and amplified received signals, and summing means for adding the gated signals to the received signals.

The invention includes a follow-on processor unit which generates the envelope of the summed signals, and control signal generating means which compares the slowly varying, low frequency envelope signals with a preselected threshold reference signal and which generates a control signal whenever the envelope signal exceeds the predetermined threshold. In the preferred embodiment, a bipolar threshold detector arrangement is employed which is sensitive to low-frequency motion both towards and away from the detecting sensors employed.

In the preferred embodiment, the invention is used to control the application of electrical power to a utilization device, such as the lighting in the room monitored by the sensing device, the embodiment including switching means having means for generating a power-on signal for the utilization device, means for normally generating a power-off signal for the utilization device after a predetermined timeout period, the power-off signal generating means including means coupled to the control signal generating means for resetting the predetermined timeout period in response to the generation of the control signal. The power-off signal generating means includes an incrementable counter driven by a low-frequency count signal generator, the incrementable counter having a reset input terminal coupled to the control signal generating means for enabling the counter to be reset to a starting count whenever the threshold comparator generates a control signal, thereby indicating the occurrence of human motion in the room. In the absence of the generation of a control signal within the predetermined timeout period, the counter reaches the final count state, which is preselectable by means of a settable switch, and the power-off signal is generated, thereby terminating application of power to the utilization device.

The entire system may be incorporated into a conventional utility junction box, which shields the electronic circuit components from any stray radiation fields, and which can be installed in a conventional ceiling panel, wall panel or the like. The housing is preferably provided with a one-way locking theft deterent arrangement which enables the device to be slip-fitted into a suitable aperture provided in the mounting panel but which prevents ready removal of the device without destroying the region surrounding the mounting panel.

In addition to being substantially insensitive to any of the environmental factors listed above which adversely affect prior art devices, the invention requires no special optical or mechanical radiation focusing elements. Further, the invention has wide application in both energy controlling installations and intrusion detection installations.

For a fuller understanding of the nature and advantages of the invention, reference should be had to the ensuing detailed description taken in conjunction with the accompanying drawings.

DESCRIPTION OF THE PREFERRED EMBODIMENTS

Figure 1:
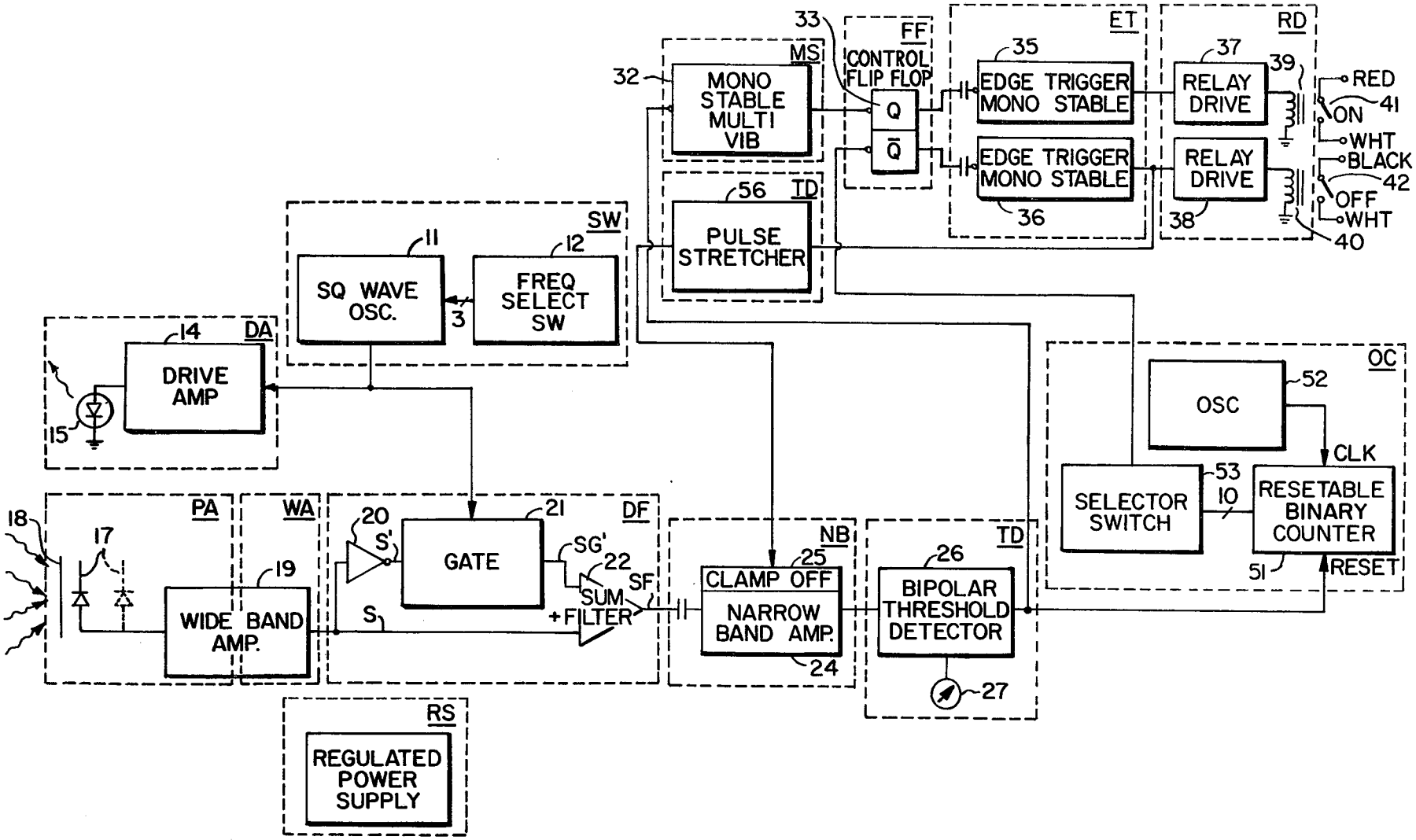
FIG. 1 is a block diagram of a system embodying the invention for use in a light controlling application.
Figure 2:
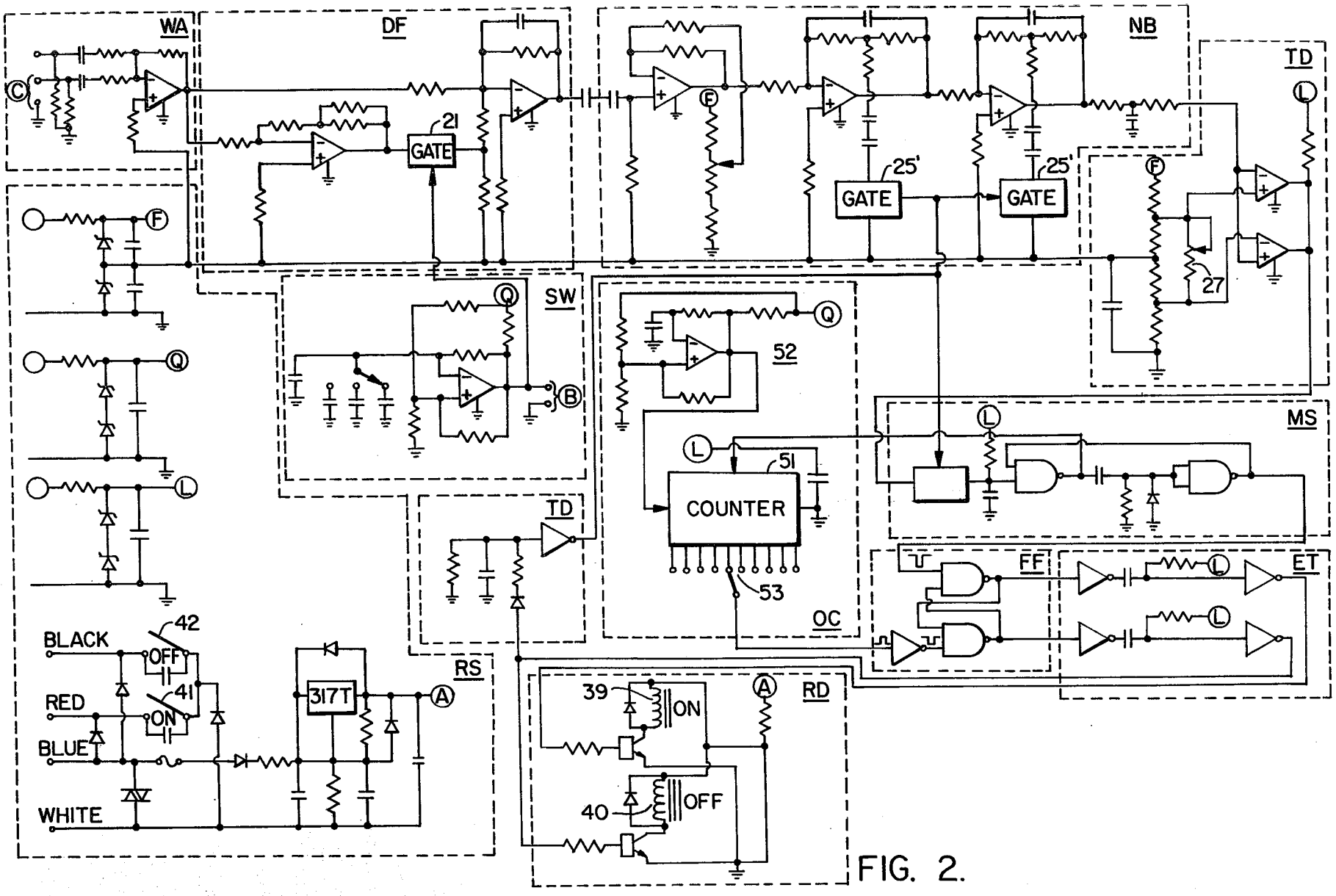
FIG. 2 is a circuit schematic of the major portions of the block elements in FIG. 1.

Turning now to the drawings, FIG. 1 illustrates an embodiment of the invention designed for use in controlling one or more associated utilization devices requiring the application of electrical power, while FIG. 2 is a circuit schematic illustrating the electrical components comprising the various block elements of FIG. 1. More particularly, the block elements surrounded by the broken line border, such as the square wave oscillator and frequency select device designated with the characters SW are shown at the component level in FIG. 2 in the region surrounded by the broken line rectangle bearing the same alpha characters. In addition, in the circuit schematic of FIG. 2 common circuit connection points are designated with single alpha characters surrounded by a circle. For example, connection point Q of the regulated power supply RS is coupled to the connection point Q shown in the oscillator section SW and the resettable counter unit OC.

Figure 3:
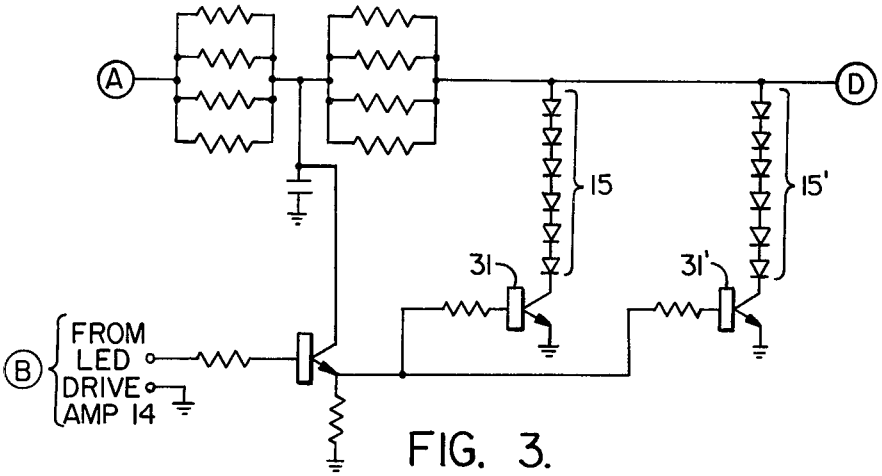
FIG. 3 is a circuit schematic of the transmitting portion of the FIG. 1 system.

An oscillator unit SW includes a square wave oscillator 11 for generating a pulsed signal train at a frequency selectable by means of a frequency select switch unit 12 which is manually settable in accordance with the requirements of a particular application, and which comprises a number of individual capacitors and a switch. Alternatively, jumper leads may be used in place of a switch. The pulsed signal train from oscillator 11 is coupled to the input of a drive amplifier 14, the output of which comprises an amplified version of the input signal train and is used to drive a radiation transmitting device, illustrated as a diode 15, in a pulsed mode of operation. The drive amp unit DA is shown at the circuit level in FIG. 3 and includes a first bank of serially connected diode radiation generation elements 15 operated by a switching transistor 31 and a second bank of diode radiation generation devices 15' operated by a switching transistor 31'. The diode elements are preferably type LD 271 infrared light emitting diodes available from Litronix, Inc. of Cupertino, Calif.

The signal train output from oscillator 11 is also coupled to the control input terminal of a gate 21 in a digital fiber section DF and is used to gate certain signals in the manner described below.

The system further includes a detector/preamplifier PA having one or more detectors 17 capable of generating electrical signals in response to the receipt of reflected radiation of the wavelength generated by radiation generator 15. In the preferred embodiment, the radiation of interest is 9500 angstroms and the detectors are type BPW34 units available from Litronix, Inc.; however, radiation of other wavelengths may be employed as desired. An optional optical filter 18 is provided for detectors 17 which functions to filter out radiation having wavelengths different from the wavelength of interest. The output of the detector 17 is coupled to the input of a preamplifier portion PA of a wide band amplifier 19, the detector and preamplifier portions being shown at the circuit level in FIG. 4. The output of the preamplifier portion PA is coupled to the wide band amplifier portion WA of the wide band amplifier 19, which functions to boost the signals from the detector 17. In the preferred embodiment, amplifier 19 has a band width of approximately 50 KHz.

Figure 4:
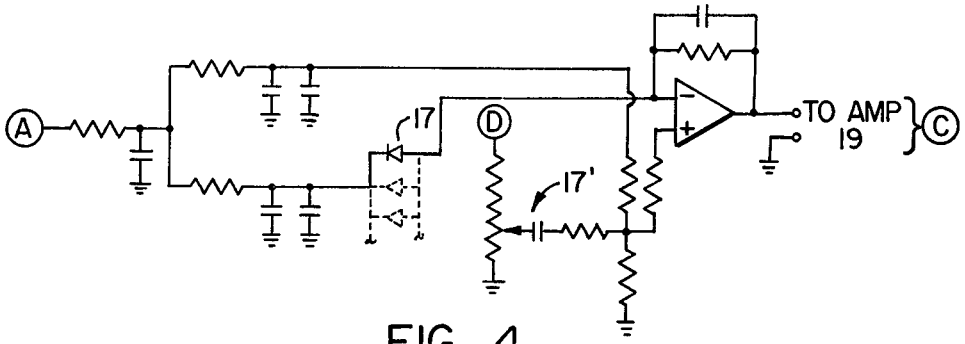
FIG. 4 is a circuit schematic of the detector and preamplifier portion of the FIG. 1 system.

In order to improve the noise rejection performance of the preferred embodiment and to increase the linear dynamic range, the average amplitude of the signals generated by detectors 17 are partially offset with a signal corresponding to the actual transmitted radiation by means of the variable resistance circuit 17' shown in FIG. 4.

The amplified detected signals present at the output of amplifier 19 are coupled directly via one line S to one input of a sum and filter portion of the digital filter unit DF. The output signals from amplifier 19 are also inverted and amplified by means of an inverting amplifier 20 to provide signals on line S' which are coupled to the transfer input of gate 21. The signals which are transfered through gate 21 and appear on transfer output terminal SG' are coupled to the other input of sum and filter unit 22.

Figure 5:
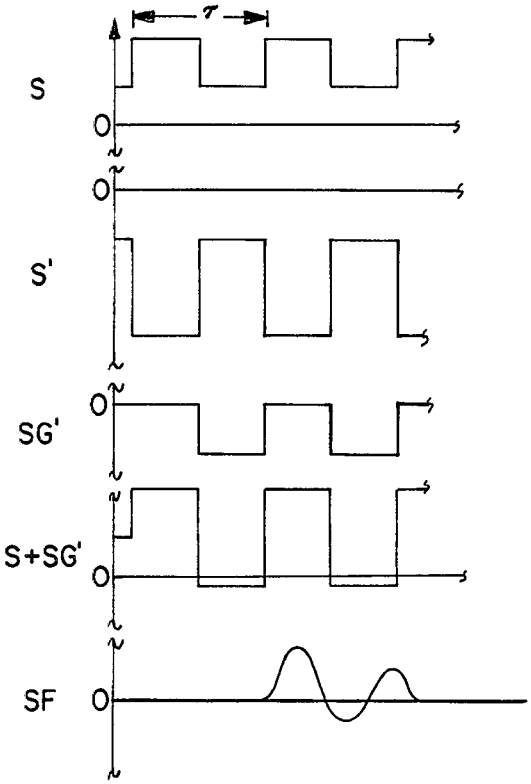
FIG. 5 is a wave form diagram illustrating the operation of portions of the FIG. 1 system.

FIG. 5 illustrates the processing which is applied by unit DF to the received electrical signals representative of the reflected radiation sensed by detector 17. With reference to this Fig., the direct input signals present on conductor S have the general square wave form shown with period $\tau$ (approximately 50 microseconds in the preferred embodiment). The minimum amplitude of these signals lies somewhere above the zero threshold, depending upon the level of the background radiation, the biasing voltages employed and the like. The signals present on conductor S' are inverted replicas of the direct signals and, in the preferred embodiment, are amplified by a factor of two and lie below the zero base line a corresponding distance. The gated signals on conductor SG' are modified versions of the S' signals obtained by blocking transmission of those portions of the signals present at the transfer input terminal of gate 21 which undergo negative excursions and substituting a zero level signal, while transmitting the other half cycle portions through gate 21. The signals resulting from the summation of the S' and SG' signals comprise processed versions of the original S signals with the base line lowered below the zero reference point as shown. The digital filtering is primarily employed to normalize the S signals in order to remove variations caused by fluctuations in the background radiation level sensed by detector 17. The summed signals are passed through a low pass filter in unit 22 to produce the envelope thereof on conductor SF as illustrated in FIG. 5. It should be noted that the time scale for the SF signals is highly compressed in FIG. 5 with respect to the remaining signals illustrated therein.

Figure 6:
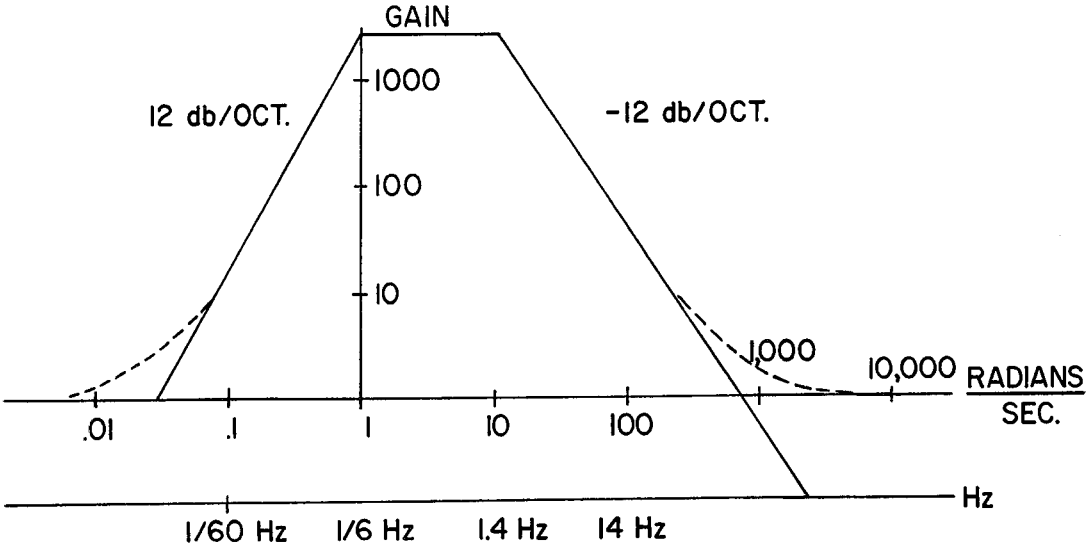
FIG. 6 is a diagram showing the bandpass characteristics of the narrow-band amplifier unit of the system of FIG. 1.

The envelope signals from sum and filter unit 22 are AC coupled to the input of the narrow band amplifier 24 in unit NB in which only the extremely low frequency envelope signals are amplified. The band pass characteristics for amplifier 24 are illustrated in FIG. 6 for the preferred embodiment, with signals in the range from about 1/60th Hz to about 14 Hz being the primary signals of interest. Narrow band amplifier unit NB also includes a clamp-off portion 25, described below.

The low frequency signals output from amplifier 24 are coupled to the input of a bipolar threshhold detector unit TD in which low frequency excursions above a predetermined positive threshhold and below a predetermined negative threshhold are sensed. The positive excursions correspond to low frequency motion towards detector 17, while the negative excursions correspond to motion away from detector 17. The threshhold detector 26 generates a binary output signal in response to the low frequency excursions beyond the two threshholds. A sensitivity adjustment potentiometer 27 enables the threshholds to be varied in accordance with the requirements of any particular application.

The binary control signals generated at the output detector 26 are used in the preferred embodiment to control the application of AC power to an associated utilization device, such as fluorescent lights in the zone of interest, typically a room in a structure. For this purpose, the output of detector 26 is coupled to the trigger input of a monostable multivibrating unit 32, the output of which is coupled to the set input of a control flip-flop 33. Monostable multivibrator 32 functions as a pulse shaping circuit in the preferred embodiment. The set output of control flip-flop 33 is coupled to the input of an edge trigger monostable multivibrator 35, which also functions as a pulse shaping device, and the output of monostable multivibrator 35 is coupled to the input of a power-on relay drive unit 37, the output of which is coupled to a relay coil 39. In response to the setting of control flip-flop 33, monostable multivibrator 35 generates an output pulse which causes relay drive 37 to operate coil 39 to momentarily close switch 41 for a predetermined minimum time period (approximately 150 milliseconds) sufficient to operate an external relay coupled to one side of the AC main feed to the utilization device.

The binary control signal from threshhold detector 26 is also coupled to the reset input of a resettable binary counter 51 having a clock input generated by a low frequency oscillator 52. Binary counter 51 is a conventional device capable of being set to an original count state and incremented in accordance with the clock signals from oscillator 52. In the preferred embodiment, oscillator 52 has a frequency of about 1 Hz. The count states of counter 51 are decoded by means of a selector switch 53 and applied to the reset input of control flip-flop 33. Depending on the setting selected for switch 53, counter 51 functions to provide a count-down period of predetermined duration which, once reached, causes control flip-flop 33 to reset. The reset output from control flip-flop 33 is coupled to the input of a monostable multivibrator 36, essentially identical to multivibrator 35, and which functions to provide pulse shaping for the reset output signal from flip-flop 33 and to operate the relay drive 38, essentially identical to relay drive 37. Upon receipt of an output pulse from multivibrator 36, relay drive 38 energizes a coil 40, which momentarily closes a power off 42, which is coupled to the external relay associated to the utilization device.

The output of multivibrator 36 is also coupled via a pulse stretcher network 56 to the input of clamp-off circuit 25 in the narrow band unit NB. As seen in FIG. 2, clamp-off circuit 25 comprises a pair of gates 25' essentially identical to gate 21 but functioning to disable two stages of the narrow band amplifier, when activated. The pulse stretcher network 56 provides a pulse to the clamping circuit which persists longer than the time required to operate the relay drive units 37, 38 in order to prevent erroneous operation of the system.

A regulated power supply unit RS converts AC power present on the input terminals labelled BLUE and WHITE into DC operating power for the system subunits, as shown in FIG. 2. In addition, power supply unit RS routes power to control output terminals labelled RED and BLACK via relay switches 41 and 42, respectively.

In operation, whenever a human being is present and moving in the zone of interest monitored by detector 17, low frequency variations in the pulse modulated reflected signals are detected and threshhold detector 26 generates the binary control signal indicative of this motion. Upon the first occurrence of the control signal from detector 26, control flip-flop 33 is set, which causes relay drive 37 to close the power-on switch 41, thereby generating a power-on signal for the associated utilization device. In addition, counter 51 is reset to the initial state and thereafter is incremented by oscillator 56. So long as the human motion persists in the zone of interest, a succession of control signals are generated at the output of detector 26, each of which serves to reset counter 51 to the initial reset state. When the human leaves the zone of interest, e.g. by exiting the room, counter 51 eventually is incremented to the predetermined count specified by selector switch 53, and control flip-flop 33 is reset. The resetting of flip-flop 33 causes the relay drive 38 to close the power-off switch 42, thereby generating a power-off signal for the associated utilization device. Thereafter, the power will remain off until the motion of a human being is again sensed in the zone of interest.

Figure 7:
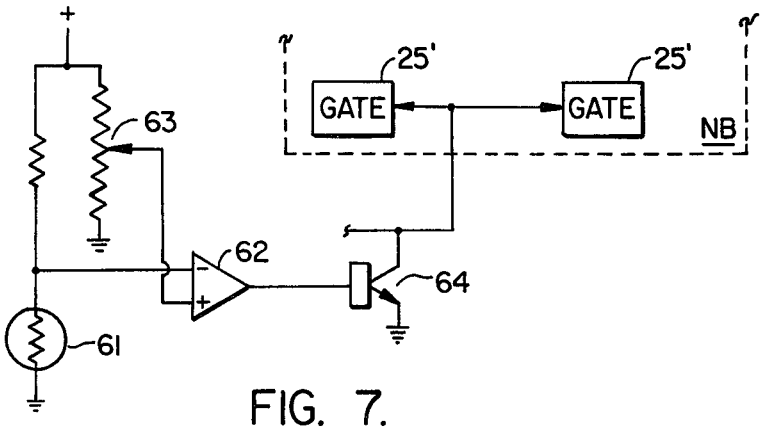
FIG. 7 is a schematic diagram showing an ambient sensor modification of the FIG. 1 embodiment.

With reference to FIG. 7, when the invention is used in an application for controlling the lighting in a room, an ambient radiation sensing circuit may be employed to override the operation of the human motion sensing feature in order to avoid unnecessary operation of the room lights and thereby conserve even more electrical power. FIG. 7 shows one example of an implementation of this override feature and the implementation includes a visible light sensor 61 coupled to one input of a comparator 62, the other input to which is a reference threshold signal generated by an adjustable threshold sensing device, such as potentiometer 63. The output of comparator 62 is coupled to the control input of a clamping transistor 64, the output of which is coupled to the control input of gates 25' in the clamp-off circuit of the narrow band unit NB. In use, in response to a signal from sensor 61 higher than the reference threshold provided by potentiometer 63, indicating sufficient ambient light to illuminate the room under observation, transistor 64 is switched on thereby operating gates 25' and disabling the operation of the narrow band amplifier.

Figure 8:
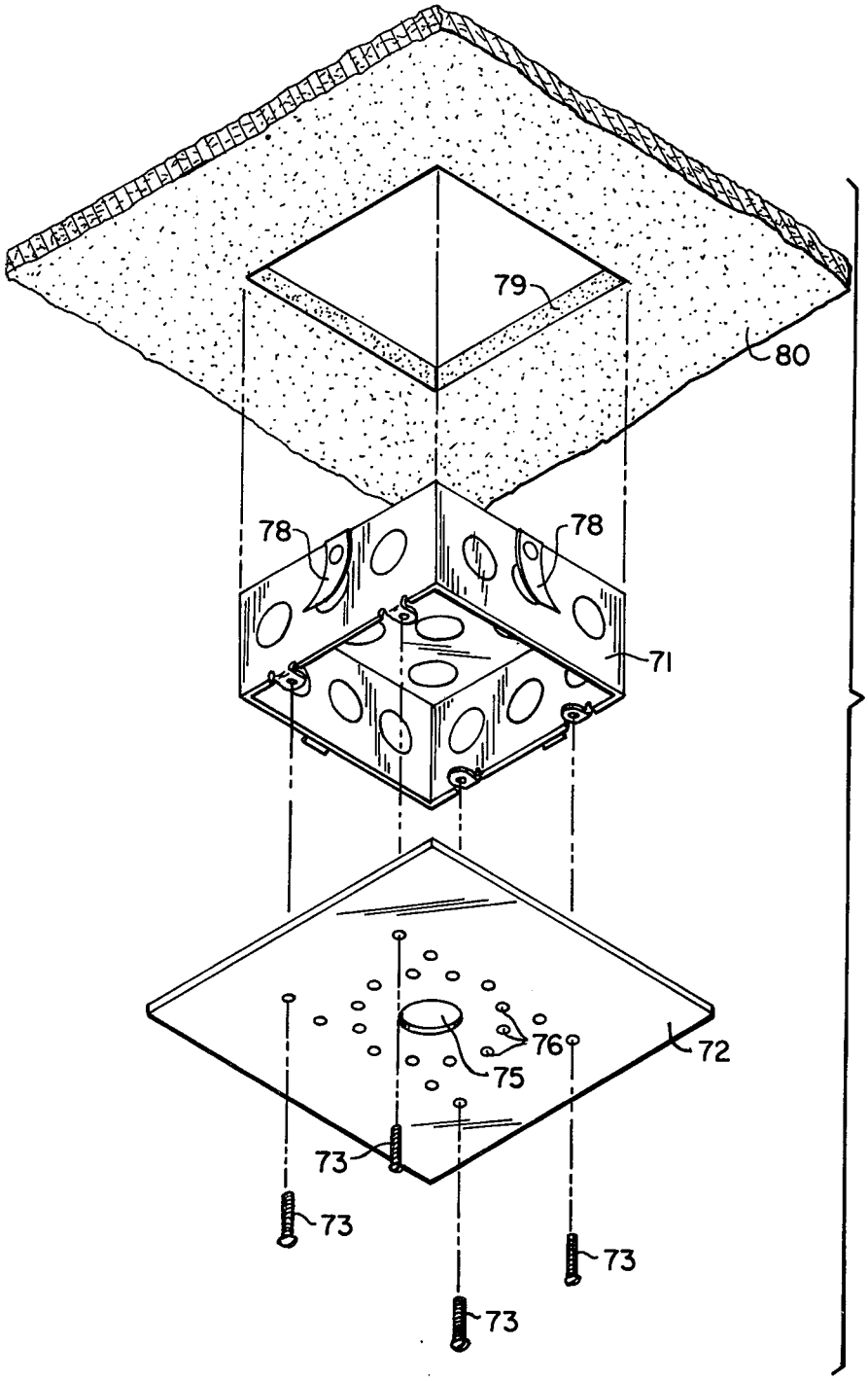
FIG. 8 is an exploded perspective view illustrating the manner in which the system of FIG. 1 is typically installed.

FIG. 8 illustrates a preferred mounting arrangement for the system described above. As seen in this figure, a conventional junction box 71 is provided with a cover 72 fastened to the open face of box 71 by any suitable fastening means, such as conventional bolts 73. The circuit board on which the components comprising the system of FIG. 1 are located is mounted on the inner surface of face plate 72 (and not illustrated). A central aperture 75 is provided as a window for the radiation generator 15; a plurality of apertures 76 arranged concentrically about central aperture 75 are provided for detectors 17.

Junction box 71 is provided with a plurality of outwardly curved spring fingers 78 which function to frictionally retain the assembly of box 71 and plate 72 in a corresponding aperture 79 in a conventional ceiling panel 80. The assembly is mounted in the panel 80 by simply press fitting the device into the aperture 79. Thereafter, any attempt to remove the assembly will result in destruction of the panel 80, which serves as a theft deterrent for the device, while at the same time permitting simple and rapid installation thereof.

Figure 10:
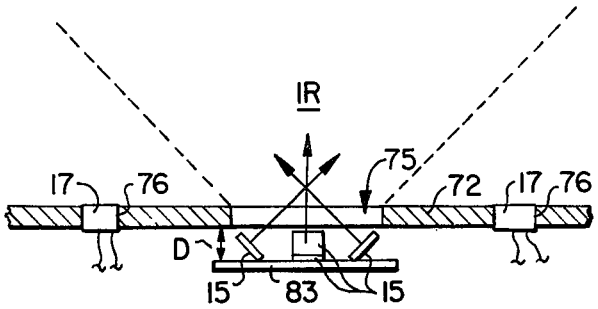
FIG. 10 is a sectional view taken along lines 9—9 of FIG. 8.
Figure 9:
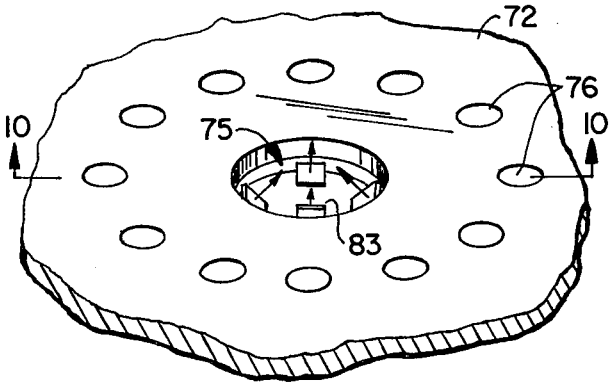
FIG. 9 is an enlarged partial perspective view illustrating the transmitter and detector portion of the invention.

FIGS. 9 and 10 illustrate in greater detail the preferred arrangement of the radiation generators 15 and the radiation detectors 17. As seen in these Figs., a plurality of LEDs 17 are mounted on a suitable platform 83 a predetermined separation distance D below the inner surface of mounting plate 72. The major axis of radiation (i.e. the axis at which the radiation is at a maximum, which is perpendicular to the face surface of each LED die 17) is arranged in such a manner that the axes are mutually non-parallel and provide a cone of radiation exiting from the aperture 75 in plate 72. The distance D is selected to be sufficiently large that radiation emanating from the LEDs 17 does not directly strike the detectors 17 mounted in the apertures 76. It should be noted that, by adjusting the distance D, the angle of the cone of radiation can be changed to flood a larger or smaller area of the zone of interest directly below the exposed surface of plate 72. As will be further apparent to those skilled in the art, other geometrical configurations for the radiation transmitting LEDs 15 and the radiation detectors 17, may be employed; and further that the physical locations of the radiation generators 15 and the radiation detectors 17 may be transposed so that detectors 17 are located in the central aperture 75 and the radiation generators 15 are located in the surrounding apertures 76. The preferred configuration may vary for different applications, and may be best determined on an empirical basis.

Figure 11:
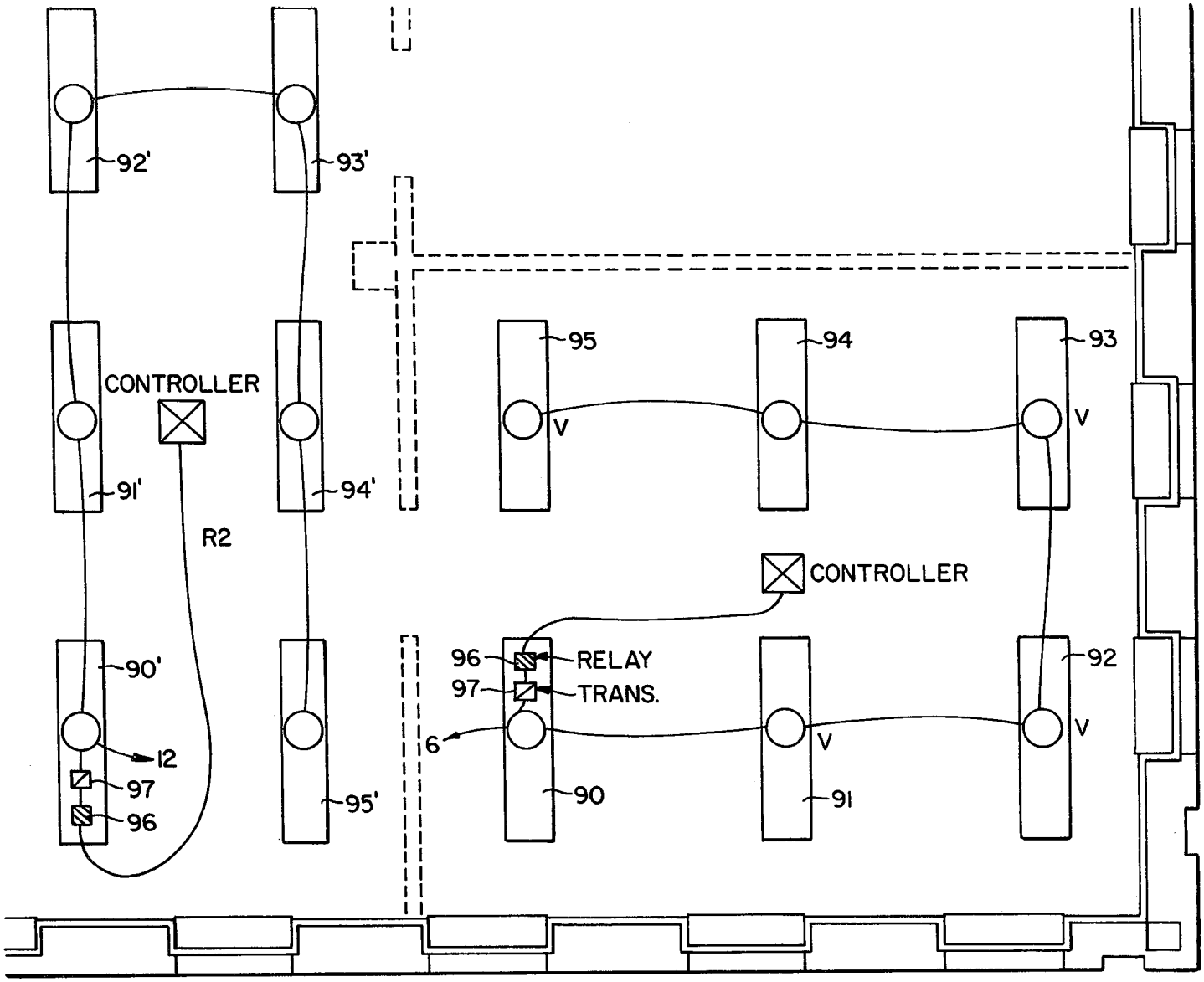
FIG. 11 is a schematic top plan view illustrating an application of the invention for use in controlling the lights in a particular room with one unit.
Figure 12:
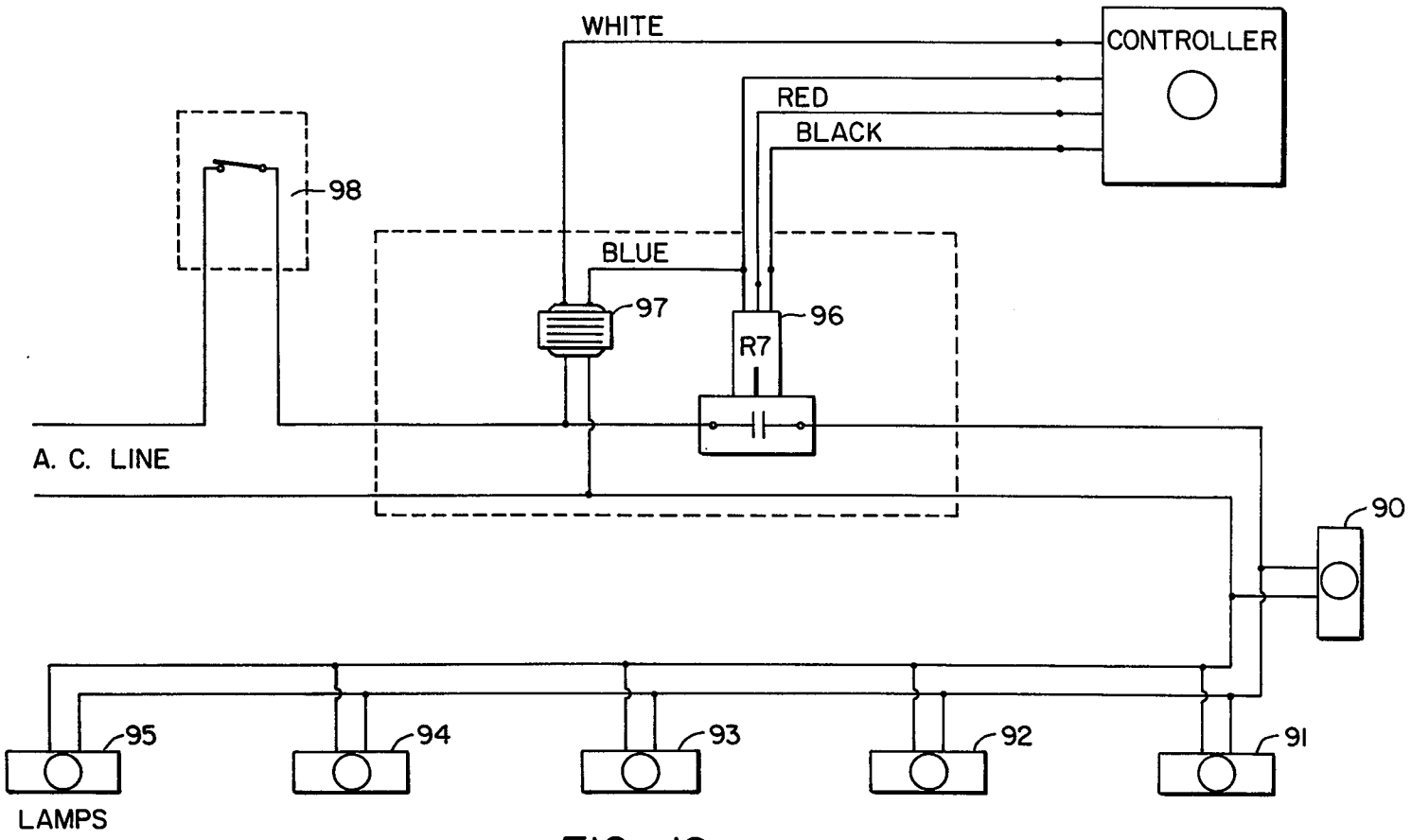
FIG. 12 is an AC circuit diagram of the FIG. 10 arrangement.

FIG. 11 is a schematic top plan view illustrating the manner in which the invention may be employed to control the light in a plurality of adjacent room areas, each controller being used to control the operation of a plurality of lights. As seen in this Fig., a first room R1 is provided with a single controller in the ceiling at the geometric center thereof, the output cable from the controller, bearing the power on and power off signals, being connected to a relay 96 mounted on a first fluorescent light fixture 90 connected in series with additional light fixtures 91–95. Relay 96 is a conventional latching relay, preferably a General Electric type RR7 control relay, the relay being coupled to a standard transformer 97, such as a Class Two 24 VAC transformer. A typical wiring diagram is illustrated in FIG. 12, the interconnections using the same color code designation as that found in FIG. 2. As seen in FIG. 12, the control relay 96 is inserted in one side of the AC line in order to control the application of power of the light fixtures 90–95. If desired, the transformer 97 and control relay 96 may be coupled to one side of the AC mains electrically upstream of the wall switch 98 shown in FIG. 12.

Returning to FIG. 11, a second controller, transformer 97 and relay 96 are shown mounted in an elongated room, with the controller again located centrally of the room and the relay 96 and transformer 97 being physically mounted to the top of the first fluorescent light structure 95.

Figure 13:
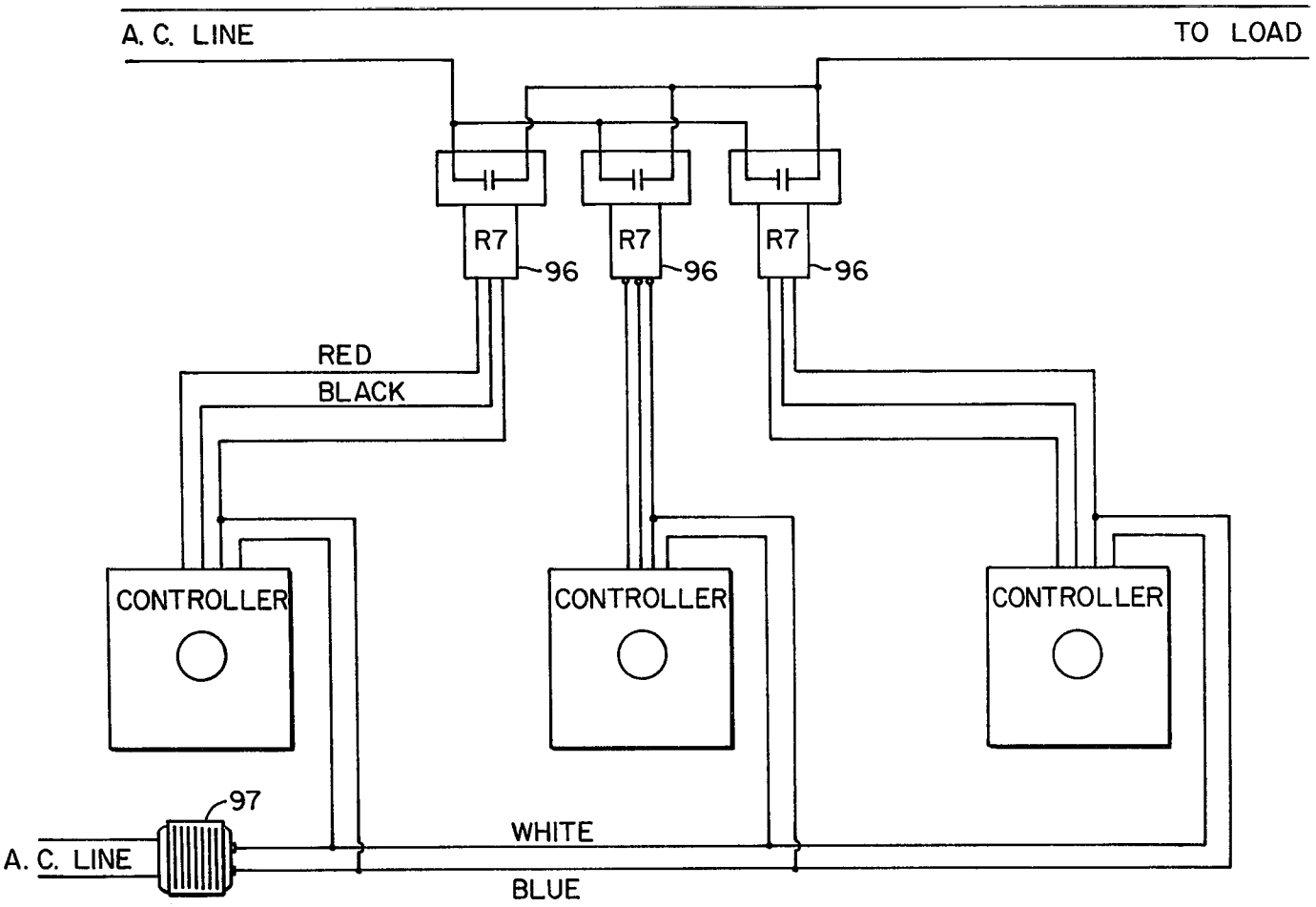
FIG. 13 is an AC connection diagram illustrating the use of a plurality of units to control the application of power to a common load.

FIG. 13 illustrates an alternate configuration of the invention in which three controllers and three relays 96 are used in combination with one transformer 97 to control the operation of an AC load. In this configuration, the detection of the motion of a human being by a single controller causes the load to be applied to the utilization device (e.g., the fluorescent lights 90–95). As will be apparent to those skilled in the art, various combinations of controllers, relays, and transformers may be employed, which provides great flexibility in the planning of a system using the invention. In addition, each controller may employ radiation of a different modulation frequency from the other controllers in order to avoid cross-detection in some applications (i.e., if two or more of the separate controllers shown in FIG. 13 emit radiation into a common zone, so that cross-detection is possible). Each controller then propagates a separate high frequency modulated radiation signal into a zone at a different modulated frequency, so the respective controllers produce independent indications of low frequency variations in reflected radiation. The outputs of the three controllers in FIG. 13 are connected to the three relays 96, respectively, so that the control signals produced by the bi-polar threshold detector 26 (FIG. 1) of each of the three controllers represent independent indications of the low frequency variations to one or more associated utility devices.

Human motion sensing systems and energy controllers constructed in accordance with the invention possess many advantages over known prior art devices. Since the invention operates in accordance with the radar return equation, viz the change in the intensity of the reflected radiation received by the detectors 17 is directly proportional to the area of the reflecting object and the diffusion reflection coefficient of the reflecting object and inversely proportional to the fourth power of the radial separation distance between the detectors and the object, the device can sense both radial motion and variations in the diffuse reflection due to lateral movements of objects in the room. Further, the sensitivity of the invention is proportional to both the size of the object and the speed of motion. The invention may be employed as an energy controller for a wide variety of utilization devices such as office equipment, power equipment, heating and ventilating equipment, water, gas and other utilities. In addition, the device may be used as an intrusion detector by simply providing a suitable alarm, either local or remote or both. In addition, although mechanical focusing of the radiation as illustrated in FIGS. 9 and 10 may be provided, this is not an absolute requirement; in many applications, no special focusing need be employed, while in others optical focusing using appropriate lens elements may be provided.

Further, the invention may be employed in other geometrical configurations than that illustrated in FIG. 11. For example, an entire elongated hallway region may be monitored as the zone of interest, if desired, by providing specular reflective material along the hallway, typically by using commercially available reflectors (such as flexible reflective tape) along the baseboard of the hallway. In addition, the invention may be arranged to detect radiation from within the confines of a room only, and may also be employed to observe radiation both within the room and from adjacent space, either through an opening in a wall or through a glass window or the like.

Moreover, no elaborate special wiring is required to install the invention in the applications envisioned; only access to one side of the AC mains is required to control the operation of the AC power utilization device. As a result of this feature, as well as the simple mounting arrangement illustrated in FIG. 8, the invention may be installed by a person having minimal skill in a rapid manner.

In addition, the invention is insensitive to non-real objects, such as thermal drafts, convection currents, conduction currents, or the like, and it is further insensitive to stray radiation of the type normally encountered in structural environments. Moreover, the threshold sensitivity of the invention may be preset upon fabrication, or may be tailored to each installation site to provide optimum operation of the system.

While the above provides a full and complete disclosure of the invention, various modifications, alternate embodiments and equivalents may be employed without departing from the spirit and scope of the invention. For example, other types of radiation generating devices, such as gas discharge tubes, externally modulated radiation generating devices, and even laser diodes may be used in place of LEDs 15. In addition, if necessary and desirable the physical location of the radiation generator 15 and the radiation detector 17 may be made separate from one another, and the processing electronics illustrated in FIGS. 1 and 2 may be located, if desired, at still another physical location. Also, different mechanical mounting arrangements may be employed for the units, such as a simple surface mount, as desired. Lastly, the invention may be tailored to other applications in which motion of inanimate objects—such as cartons on a conveyor line—lying within a relatively narrow frequency range is to be detected. Therefore, the above description and illustrations should not be construed as limiting the scope of the invention, which is defined by the appended claims.

What is claimed is:

1. A method for detecting the presence or absence of relatively low frequency motions of objects in a zone of interest, said method comprising the steps of:

propagating high frequency modulated radiation lying in a predetermined portion of the spectrum into said zone of interest;

detecting said radiation reflected from objects in said zone, said detecting including the step of generating electrical signals representative of the detected radiation;

processing the detected radiation to determine the presence of relatively low frequency variations therein, said processing including the step of normalizing said electrical signals to remove variations caused by changes in the level of background radiation present in said zone, said normalizing including the steps of generating inverted amplified signals from the original electrical signals, partial cycle gating of said inverted amplified signals, and summing the partial cycle gated signals with the original electric signals; and generating a control signal when said low frequency variations are present.

2. The method of claim 1 wherein said modulated radiation lies in the infrared portion of the spectrum.

3. The method of claim 1 wherein said step of propagating includes the step of generating pulse modulated radiation.

4. The method of claim 3 wherein said step of generating includes the steps of producing a high frequency clock signal, amplifying said signal to produce a corresponding pulsed drive signal, and operating at least one radiation source with said pulse drive signal.

5. The method of claim 1 wherein said step of propagating includes the step of propagating a plurality of sets of high frequency modulated radiation into said zone, each of said sets having radiation modulated at a different frequency from the remaining sets; and wherein said steps of processing and generating are each performed on said plurality of sets to produce independent indications of said low frequency variations.

6. The method of claim 5 wherein each set of radiation is directed into a different region of said zone.

7. The method of claim 5 further including the step of using said independent indications to supervise the operation of at least one associated utility device.

8. The method of claim 5 further including the step of using said independent indications to supervise the operation of a plurality of associated utility devices, each independent indication being used to control the operation of a different one of said plurality of associated utility devices.

9. The method of claim 1 wherein said step of propagating includes the step of focusing said high frequency modulated radiation into a beam having a predetermined geometrical configuration.

10. The method of claim 1 wherein said step of propagating includes the steps of providing a plurality of sources of said high frequency modulated radiation, each of said sources having an axis of maximum radiation transmission, and arranging said plurality of sources so that said axes are mutually non-parallel.

11. The method of claim 1 wherein said step of detecting is preceded by the step of optically filtering the reflected radiation to remove radiation lying outside said predetermined portion of the spectrum.

12. The method of claim 1 wherein said step of processing includes the step of low pass filtering said electrical signals to generate the envelope thereof, wherein, said modulated radiation lies in the infra-red portion of the spectrum;

said high frequency is about 20 khz; and said low frequency is in the range from about 10 hz to about one cycle per minute.

13. The method of claim 12 wherein said step of processing includes the step of comparing the envelope signals with a predetermined threshold; and wherein said step of generating includes the step of providing said control signal whenever said envelope signals exceed said threshold.

14. The method of claim 1 further including the step of using said control signal to supervise the operation of an associated utility device.

15. The method of claim 14 wherein said utility device requires the application of electrical power for the operation thereof; and wherein said step of using includes the steps of providing a retriggerable time-out device for supplying said power to said utility device for a predetermined time period, and applying said control signal to said time-out device to restart said predetermined time period.

16. The method of claim 14 wherein said step of using is performed on a plurality of utility devices.

17. The system of claim 1 further including means for applying said control signal to an associated utility device to supervise the operation thereof.

18. The system of claim 17 wherein said utility device requires the application of electrical power for the operation thereof; and wherein said applying means includes retriggerable time-out means for supplying said power to said utility device for a predetermined time period, said time-out means having a trigger input terminal coupled to said generating means so that said predetermined time period is restarted whenever said control signal appears.

19. The system of claim 17 wherein said applying means is coupled to a plurality of associated utility devices.

20. A system for detecting the presence or absence of relatively low frequency motion of objects in a zone of interest, said system comprising:

means for propagating high frequency modulated radiation lying in a predetermined portion of the spectrum into said zone of interest;

means for detecting said radiation reflected from objects in said zone, said detecting means including means for generating electrical signals representative of the detected radiation;

means for processing the detected radiation to determine the presence of relatively low frequency variations therein, said processing means including means for normalizing said electrical signals to remove variations caused by changes in the level of background radiation present in said zone, said normalizing means including means for generating inverted amplified signals from the original electrical signals, means for gating predetermined partial cycle portions of said inverted amplified signals, and means for summing the partial cycle gated signals with the original electrical signals; and means for generating a control signal when said low frequency variations are present.

21. The system of claim 20 wherein said propagating means includes means for generating modulated radiation lying in the infrared portion of the spectrum.

22. The system of claim 20 wherein said propagating means includes means for generating pulsed modulated radiation.

23. The system of claim 22 wherein said generating means includes means for producing a high frequency clock signal, means for amplifying said signal to produce a corresponding pulsed drive signal, and at least one radiation source coupled to said amplifying means.

24. The system of claim 20 wherein said high frequency is about 20 KHz.

25. The system of claim 20 wherein said low frequency is in the range from about 10 Hz to about one cycle per minute.

26. The system of claim 20 wherein said propagating means includes means for propagating a plurality of sets of high frequency modulated radiation into said zone, each of said sets having radiation modulated at a different frequency from the remaining sets; and wherein said detecting means, said processing means and said generating means are responsive to said plurality of sets to produce independent indications of said low frequency variations.

27. The system of claim 26 wherein said propagating means includes means for directing each said set of radiation into a different region of said zone.

28. The system of claim 26 wherein said generating means is coupled to at least one associated utility device to supervise the operation thereof in accordance with said independent indications of said low frequency variations.

29. The system of claim 26 further including means for applying the control signals generated by said generating means and representative of independent indications of said low frequency variations to a plurality of associated utility devices, each control signal representative of a different one of said independent indications being coupled to a different one of said plurality of associated utility devices.

30. The system of claim 20 wherein said propagating means includes means for focusing said high frequency modulated radiation into a beam having a predetermined geometrical configuration.

31. The system of claim 20 wherein said propagating means includes a plurality of sources of said high frequency modulated radiation, each of said sources having an axis of maximum radiation transmission, said plurality of sources being arranged with said axes mutually non-parallel.

32. The system of claim 20 wherein said detecting means includes means for optically filtering the reflected radiation to remove radiation lying outside said predetermined portion of the spectrum.

33. The system of claim 20 wherein said processing means includes means for low pass filtering said electrical signals to generate the envelope thereof.

34. The system of claim 33 wherein said processing means further includes means for comparing said envelope signals with a predetermined threshold; and wherein said generating means includes means for providing said control signal whenever said envelope signals exceed said threshold.

35. A processor for use in detecting the presence or absence of a moving object from a zone of interest in response to relatively low frequency variations in reflected high frequency modulated radiation lying within a predetermined portion of the spectrum, said processor comprising:

input means for receiving electrical signals representative of said high frequency modulated radiation reflected from objects in said zone of interest;

amplifying means coupled to said input means for amplifying said electrical signals;

means for generating the envelope of said electrical signals; and means coupled to said envelope generating means for generating a control signal in response to relatively low frequency variations in said envelope, wherein said radiation comprises pulse modulated radiation, and wherein said envelope generating means includes oscillator means for generating a gate control signal synchronized with said pulse modulated radiation, means for inverting and amplifying said electrical signals, gating means having a transfer input coupled to said inverting and amplifying means, a transfer output, and a control input coupled to the output of said oscillator means, said gating means including means responsive to said gate control signal from said oscillator means for enabling transfer of a portion of each cycle of the signals output from said inverting and amplifying means from said transfer input to said transfer output, and means for summing the signals output from said gating means with the signals output from said amplifying means.

36. The combination of claim 35 wherein said amplifying means comprises a wide band amplifier.

37. The combination of claim 35 wherein said envelope generating means includes low-pass filter means for forming the envelope of the signals from said summing means, and narrow-band amplifier means for amplifying the signals output from said low-pass filter means.

38. The combination of claim 35 wherein said control signal generating means includes means for generating a reference threshold signal, and comparator means coupled to said envelope generating means and said reference threshold signal generating means for generating said control signal when said envelope exceeds said reference threshold signal.

39. The combination of claim 38 wherein said reference threshold signal generating means includes means for generating a pair of reference threshold signals of opposite polarity, and wherein said comparator means comprises a bipolar comparator for generating said control signal when said envelope exceeds either one of said pair of reference threshold signals.

40. The combination of claim 35 wherein said processor further includes switching means for controlling the application of electrical power to an associated utilization device in accordance with said control signal, said switching means including means for generating a power-on signal for said utilization device, means for normally generating a power-off signal for said utilization device after a predetermined timeout period, said power-off signal generating means including means coupled to said control signal generating means for resetting said predetermined timeout period in response to the generation of said control signal.

41. The combination of claim 40 wherein said switching means further includes a control bistable device having a first control input coupled to said control signal generating means, a second control input, a first output coupled to said power-on signal generating means, and a second output coupled to said power-off signal generating means, and wherein said power-off signal generating means includes means for generating a low frequency count signal, and an incrementable counter having a count input terminal coupled to said low frequency count signal generating means, said second control input of said control bistable device being coupled to a predetermined output of said counter.

42. The combination of claim 41 wherein said low frequency count signal generating means includes means for selecting said predetermined output in order to enable variation of said predetermined timeout period.

43. The combination of claim 40 wherein said utilization device comprises at least one electrically operated lamp, and wherein said processor further includes sensing means for generating an electrical signal representative of the ambient light in said zone of interest, and means responsive to said ambient light representative signal for disabling said control signal generating means when the ambient light exceeds a predetermined threshold.

44. A method for detecting the presence or absence of relatively low frequency motion of objects in a zone of interest, said method comprising the steps of:

propagating high frequency modulated radiation lying in a predetermined portion of the spectrum into said zone of interest;

detecting said radiation reflected from said objects in said zone;

processing the detected radiation to determine the presence of relatively low frequency variations therein; and generating a control signal when said low frequency variations are present, wherein said step of detecting includes the step of generating electrical signals representative of the detected radiation;

said step of processing includes the step of low pass filtering said electrical signals to generate the envelope thereof, said step of processing includes the step of comparing the envelope signals with a predetermined threshold, said step of generating includes the step of providing said control signal whenever said envelope signal exceeds said threshold, said step of comparing includes the step of providing a pair of spaced thresholds of opposite polarity, and said step of generating includes the step of providing said control signal whenever said envelope signal exceeds either one of said thresholds.

45. A system for detecting the presence of relatively low frequency motion of objects in a zone of interest, said system comprising:

means for propagating high frequency modulated radiation lying in a predetermined portion of the spectrum into said zone of interest;

means for detecting said radiation reflected from said objects in said zone;

means for processing the detected radiation to determine the presence of relatively low frequency variations therein; and means for generating a control signal when said low frequency variations are present, wherein said detecting means includes means for generating electrical signals representative of the detected radiation, said processing means includes means for low pass filtering said electrical signals to generate the envelope thereof, said processing means further includes means for comparing said envelope signals with a predetermined threshold signal, said generating means includes means for providing said control signal whenever said envelope signals exceed said threshold, said comparing means includes means for providing a pair of spaced thresholds of opposite polarity, and said generating means includes means for providing said control signal whenever said envelope signal exceeds either one of said thresholds.

46. A system for detecting the presence or absence of relatively low frequency motion of objects in a zone of interest, said system comprising:

means for propagating high frequency modulated radiation lying in a predetermined portion of the spectrum into said zone of interest during spaced time intervals;

means for detecting said radiation reflected from objects in said zone, said detecting means including means for generating electrical signals representative of the detected radiation;

means for processing the detected radiation to determine the presence of relatively low frequency variations therein, said processing means including variation removal means for removing variations caused by changes in the level of background radiation present in said zone;

said variation removal means including means for generating inverted amplified signals from the original electrical signals, and means for summing the inverted amplified signals with the original electrical signals during time intervals when said high frequency modulated radiation is not present; and means for generating a control signal when said low frequency variations are present.

* * * * *